United States Patent [19]

Visciano

[11] Patent Number: 4,495,550

[45] Date of Patent: Jan. 22, 1985

[54] FLEXIBLE FLASHLIGHT

[76] Inventor: Joseph Visciano, 564 Holt St., West Hempstead, N.Y. 11552

[21] Appl. No.: 603,364

[22] Filed: Apr. 24, 1984

[51] Int. Cl.[3] ..... F21L 7/00

[52] U.S. Cl. ..... 362/189; 362/197; 362/202; 362/285; 362/398; 362/418; 362/186

[58] Field of Search ..... 362/189, 197, 202, 285, 362/398, 418, 186

[56] References Cited

U.S. PATENT DOCUMENTS 3,716,708 2/1973 Kaye ..... 362/189

*Primary Examiner*—Stephen J. Lechert, Jr.
*Attorney, Agent, or Firm*—Richard L. Miller

[57] ABSTRACT

A flexible flashlight which may provide light at any angle even in an environment in which the area in which to position a flashlight is extremely limited. A bellows is provided one end of which is threaded onto the body tube of a flashlight, the other end of which contains a bulb along with a lens and bezel. The bellows is made of a semi-rigid material so that once its curvature is formed it will remain fixed indefinitely until reformed by the user. The flexible flashlight may be placed on any flat surface or may be attached to any ferro-magnetic surface. In either case once the flashlight has been positioned both hands are free to perform work. An internal coiled helical cord is provided inside the bellows section to assure good electrical connection and to minimize the possibility of damaging the electrical pathway due to frequent flexion of the bellows.

8 Claims, 3 Drawing Figures

FLEXIBLE FLASHLIGHT

BACKGROUND OF THE INVENTION

The present invention relates to electrically operated illumination sources, and, more specifically to flashlights which may be used for illumination in difficult to reach areas.

It is frequently difficult to illuminate recessed areas in inaccessible areas. For example, an auto mechanic, when working underneath an automobile may have considerable difficulty in directing light from a conventional flashlight because there simply is not sufficient room for him to rotate the flashlight along all the possible axis. Even if he should succeed in correctly positioning the flashlight, he would inefficiently occupy one hand in retaining its position.

A number of solutions to this problem have been suggested. For example, flashlights are available in which the light bulb radiates light perpendicularly to the body tube of the flashlight. The difficulty to this approach is that not all lighting situations require a 90 degree angle. Another approach is to use fiber optics for illumination. The problem with this approach is that fiber optics are expensive and delicate and have a significant light transmission loss.

SUMMARY OF THE INVENTION

It is therefore a primary object of the present invention to provide a flexible flashlight which provides illumination at any angle under conditions of severely limited positioning space.

A further object is to provide a flexible flashlight which is rugged in construction.

Another object is to provide a flexible flashlight which may be rested on a flat surface and will remain in that position as long as necessary.

Another object is to provide a flexible flashlight which may be temporarily attached to any surface made of a ferro-magnetic material.

Another object is to provide a flexible flashlight which is compact for easy storage and transport.

A yet further object is to provide a flexible flashlight which is simple and inexpensive to construct.

Another yet further object is to provide a flexible flashlight which is aesthetically pleasing.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
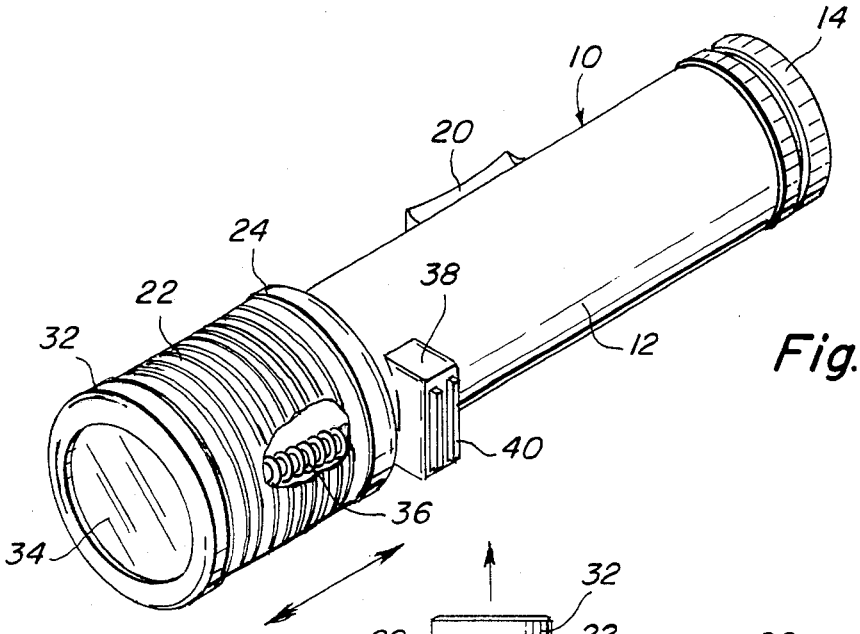
FIG. 1 is an isometric view of the invention with parts broken away to illustrate internal construction features.
Figure 2:
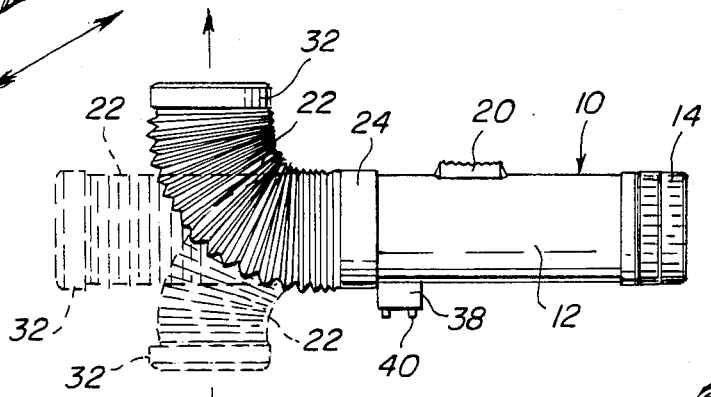
FIG. 2 is an elevational view showing how the invention may be flexed, so as to direct the light accordingly.
Figure 3:
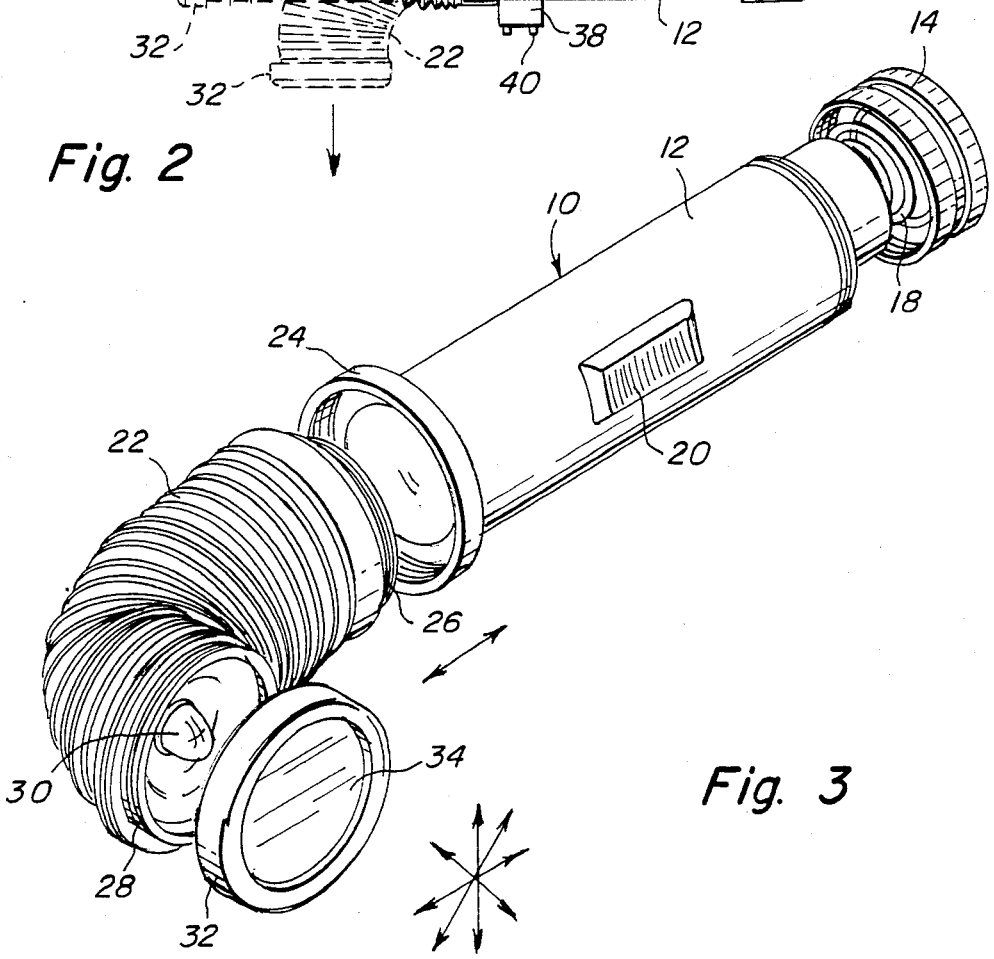
FIG. 3 is an exploded isometric view of the invention illustrating the components thereof.

The principal parts of the invention 10 may best be understood with reference to FIG. 1. A typical flashlight housing having a body tube 12 has a threaded end cap 14 screwed on to one end. This mating arrangement may be seen in FIG. 3 where threaded body tube to end cap section may be seen mating with threaded end cap 14. One or more batteries or cells are installed into an housed in the body tube 12 and then end cap 14 is installed. The batteries are held firmly in place and good electrical contact is ensured by the biasing force created by coiled spring 18. The invention 10 may be turned on and off by sliding switch 20.

The bellows 22 is screwed on to body tube 12. This mating arrangement may be seen in FIG. 3 where threaded body tube socket 24 may be seen mating with threaded bellows to body tube end ring 26. Bellows 22 is made of a semi rigid material such as thin sheet metal or plastic to form a bellows similar to that found on flexible hosing. Once the bellows is formed in position, it tends to stay in that pre-formed position until another forming force is applied this type of bellows construction is well known to those familiar with the fabrication of bellows.

At the opposite end of bellows 22 is a threaded bellows to bezel adapter 28 which holds bulb 30 in position. The inner threads of bezel ring 32 mate with the outside threads on threaded bellows to bezel adapter 28. When bezel ring 32 with associated lens 34 is screwed onto bellows to bezel adapter 28 the invention is sealed.

In order to provide flexible electrical connection between batteries and bulb 30 a helical coiled cord 36 is provided.

The invention 10 may be secured to a surface in two ways. First, the invention 10 may be rested on any surface by placing the flat side of bracket 38 on that surface. Secondly, one or more magnets such as that typified by 40 are provided in order to attach the invention 10 to any surface made of a ferro-magnetic material.

In operative use it will be seen that the instant invention 10 is a conventional flash light which permits the user to aim the light beam in any direction as desired during adverse and cramped conditions without moving the flashlight housing per se.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flexible flashlight, comprising in combination:

(a) a body tube which contains at least one battery cell;

(b) a threaded end cap which threads on to a mating threaded body tube to end cap section; wherein when said battery cell is installed into the invention said threaded end cap is installed thereby fixing said battery in place;

(c) a switch, whereby said flexible flashlight is turned on and off;

(d) a threaded body tube socket located at the opposite end of said body tube from said end cap; whereby a bellows type extension may be installed;

(e) a bellows which is attached to said threaded body tube socket by a mating threaded bellows to body tube socket;

(f) a threaded bellows to bezel adapter located at the end of said bellows furthest from said threaded bellows to body tube socket; wherein said threaded bellows to bezel adapter contains a bulb mounted coaxially at the center of saidthreaded bellows to bezel adapter whereby when said bellows in flexed said bulb radiates light in the direction extending away from the open end of said threaded bellows to bezel adapter;

(g) a bezel ring with an inside thread which mates with the outside thread on said threaded bellows to bezel adapter whereby said bezel ring has an aperture into which is fitted an optically transmitting lens;

(h) means for fixing the position of said bellows in a rigid position once it has been flexed;

(i) means for preventing said body tube from rolling off a surface once said body tube has been placed in position; and, (j) means for attaching said body tube to any surface which contains ferro-magnetic material;

(k) means for connecting said battery to said bulb in such manner as to prevent said connecting means from breaking under frequency flexion.

2. A flexible flashlight, as recited in claim 1, wherein said means for fixing the position of said bellows in a rigid position once it has been flexed further comprises a bellows constructed of a semi-rigid material.

3. A flexible flashlight, as recited in claim 1, wherein said means for preventing said body tube from rolling off a surface once said body tube has been placed in position comprises a bracket one side of which is concave and of the same radius of curvature as the mating outside curvature of said body tube; and the other side of which is a flat surface.

4. A flexible flashlight, as recited in claim 1, wherein means for attaching said body tube to any surface which contains ferro-magnetic material comprises at least one permanent magnet which protrudes through said flat surface of said bracket.

5. A flexible flashlight, as recited in claim 1, wherein means for connecting said battery to said bulb in such manner as to prevent said connecting means from breaking under frequent flexion comprises a helically coiled connection cable located inside said bellows.

6. A flexible flashlight comprising in combination any conventional flashlight housing for housing batteries, a bulb for producing a light beam, and bellows means attached to said conventional flashlight housing whereby the light beam produced by said bulb may be aimed by said bellow means in any direction with respect to said conventional flashlight housing.

7. A flexible flashlight as recited in claim 6, wherein said bellows means is constructed in such a manner that when flexed and deformed is substantial maintains it shape until it is flexed and deformed again.

8. A flexible flashlight as recited in claim 7, wherein said bellows means is attached at one end to said housing, and said bulb is mounted at the opposite end of said bellow means.

* * * * *